United States Patent [19]

Samuelson et al.

[11] 4,145,473

[45] Mar. 20, 1979

[54] ANTISTATIC FILAMENT HAVING A POLYMERIC SHEATH AND A CONDUCTIVE POLYMERIC CORE

[75] Inventors: Harry V. Samuelson, Wilmington, Del.; Dean H. Smiley, Hixson, Tenn.

[73] Assignee: E. I. Du Pont de Nemours and Company, Wilmington, Del.

[21] Appl. No.: 552,869

[22] Filed: Feb. 25, 1975

[30] Foreign Application Priority Data

Feb. 5, 1976 [IT] Italy ..... 19508 A/75

[51] Int. Cl.[2] ..... D02G 3/00

[52] U.S. Cl. ..... 428/373; 57/244; 57/901; 57/905; 264/171; 428/374; 428/397

[58] Field of Search ..... 428/373, 374, 394, 395, 428/397; 57/140 R; 264/171; 260/DIG. 17, DIG. 16, DIG. 15, DIG. 18, DIG. 19, DIG. 21, 785, 75 P, 75 T, 78 R

[56] References Cited

U.S. PATENT DOCUMENTS

| | | | |
|---|---|---|---|
| 3,533,903 | 10/1970 | Kinoshita et al. | 428/374 |
| 3,551,278 | 12/1970 | Ogata et al. | 428/395 |
| 3,558,419 | 1/1971 | Okazaki et al. | 428/374 |
| 3,616,183 | 10/1971 | Brayford et al. | 428/373 |
| 3,652,713 | 3/1972 | Okazaki et al. | 260/DIG. 17 |
| 3,803,453 | 4/1974 | Hull | 317/2 R |
| 3,900,676 | 8/1975 | Alderson | 428/372 |
| 4,005,057 | 1/1977 | Singh et al. | 260/78 S |
| 4,006,123 | 2/1977 | Samuelson et al. | 428/373 X |
| 4,035,346 | 7/1977 | Samuelson et al. | 428/373 X |
| 4,038,258 | 7/1977 | Singh et al. | 428/373 X |

FOREIGN PATENT DOCUMENTS 1237589 6/1971 United Kingdom.

*Primary Examiner*—Lorraine T. Kendell

[57] ABSTRACT

An antistatic filament having a polymeric sheath and a conductive polymeric core of a defined nature, the core constituting less than 10% of the cross-sectional area of the filament.

14 Claims, No Drawings

ANTISTATIC FILAMENT HAVING A POLYMERIC SHEATH AND A CONDUCTIVE POLYMERIC CORE

BACKGROUND OF THE INVENTION

This invention relates to antistatic synthetic filaments and more particularly to synthetic filaments having an antistatic core.

Polymeric sheath-core antistatic filaments are known. In most instances, such prior art filaments comprise conductive sheaths and nonconductive cores. Where the core component is the conductive element, relatively high melting fiber-forming polymers either with or without dispersed conductive material have been employed. At the level usually used or needed to obtain adequate static protection with a dispersed antistat, the physical properties of tenacity, modulus, recovery or shrinkage, the optical properties of luster, dye yield or dye washfastness, or the end use properties of wear durability and newness retention are adversely affected.

The polymeric core antistats used in the present invention are not suitable for fiber production by themselves because of their fluidlike character, but surprisingly these nonfiber-forming materials can be employed as very small cores in fiber-forming polymeric sheaths to provide filaments having outstanding antistatic properties. As compared to larger cores, the presence of these very small cores has little or no adverse effect on the physical, optical or end use properties of the sheath core filaments.

SUMMARY OF THE INVENTION

The present invention is directed to an antistatic filament which comprises a sheath of a fiber-forming synthetic polymer and a core consisting essentially of an organic polymer having a log $R_s$ (as defined below) of less than 10 and a glass transition temperature as measured by nuclear magnetic resonance peak ratio, $T_g$ (NMR), of less than 25° C. The conductive polymeric core is preferably selected from the group consisting of N-alkyl polycarbonamides, aliphatic polyesters and polyether esters and may contain ionic modifiers either dissolved in or copolymerized with the core polymer. The core should constitute from about 0.1% to about 10% of the cross-sectional area of the filament.

DETAILED DESCRIPTION OF THE INVENTION

The present invention concerns antistatic filaments comprising a sheath of a fiber-forming polymer and a core of a polymeric antistat which provide excellent static protection without a significant change in the inherent behavior or properties of the fiber.

The polymeric antistat core should constitute less than about 10%, preferably from about 0.1% to about 10%, more preferably from 2 to 6%, of the cross-sectional area of the filament. Cores greater than about 10%, usually introduce problems with spinning where fiber cross-sections are not round, and of fiber-property dilution due to physical displacement of the fiber polymer by the antistat. Anti-static filaments may be mixed with unmodified filaments to give antistatic yarns.

The synthetic polymers used for the sheath of the sheath-core bicomponent filaments of the present invention are high-melting, fiber-forming polymers such as polyamides, polyesters and polyolefins. As suitable polyamides for the sheath there may be mentioned poly-ω-butyramide, poly-ω-caproamide, poly-ω-dodecanoamide, poly(hexamethylene adipamide), poly(hexamethylene sebacamide), poly(hexamethylene dodecanedioamide), the polyamide from bis(4-aminocyclohexyl methane or bis(4-aminocyclohexyl)ethane and dodecanedioic acid, poly(p-xylene adipamide), poly(p-xylene dodecanedioamide) as well as copolymers from appropriately chosen lactams, or corresponding ω-aminoacids, diamines and dibasic acids of the above homopolymers. As other dibasic acids useful for preparing copolyamides, there may be mentioned isophthalic acid, terephthalic acid and hexahydroterephthalic acid.

Polyesters useful in the sheath include poly(ethylene terephthalate), poly(trimethylene terephthalate), poly(tetramethylene terephthalate), poly(ethylene terephthalate/isophthalate) (85/15), poly(ethylene terephthalate/hexahydroterephthalate) (90/10), poly(hexahydro-p-xylylene terephthalate), terephthalate copolyesters containing an aliphatic dicarboxylic acid constituent (especially terephthalate/adipate and terephthalate/glutarate copolyesters) and terephthalate copolyesters containing a branched-chain glycol constituent (especially ethylene/2,2-dimethylpropylene terephthalate copolyesters). Salts of 5-sulfoisophthalic acid, dimethyl ester, such as the sodium and potassium salts may also be used in preparing suitable copolyesters. Preferably the polyester will be a terephthalate polyester comprising at least 85 mole percent ethylene terephthalate polymer units.

Polyolefins such as polyethylene and polypropylene also may be employed as the sheath.

The polymeric antistats useful as the core of the fiber of the present invention are conductive, amorphous, fluid-like organic polymers.

The conductive polymers used in this invention have a log $R_s$ as defined below, of less than 10 and have a fluid-like mobility at normal ambient temperatures as reflected by having a glass transition temperature as measured by nuclear magnetic resonance peak ratio, herein called $T_g$ (NMR), less than 25° C. Such glass transition temperatures can be approximated by using less complicated techniques such as differential thermal analysis for convenience. Such materials are readily and permanently deformable when stressed and vary in their physical nature from rubbery compositions to low melting solids and liquids. They are not suitable for forming useful textile filaments by themselves.

N-alkyl polycarbonamides and polyether-esters are suitable polymeric antistats and may contain ionic modifiers such as organic phosphonium salts either dissolved or copolymerized therewith. Aliphatic polyesters with the ionic modifiers are also suitable.

The N-alkyl polycarbonamide core material contains tertiary amide groups as an integral part of the polymer chain. These materials are described in Br. No. 1,237,589. They may be homopolymers or copolymers from N-alkyl and N,N'-dialkyl-substituted diamines or N-alkyl amino-carboxylic acids. The copolymers may contain minor amounts of unsubstituted amines. At least 35%, preferably 50%, of the polymer-chain amide linkages should be N-substituted with an alkyl group. Suitable alkyl groups are those containing from 1 to 18, preferably 2 to 10 carbon atoms, and cycloalkyl groups containing 3 to 8, preferably 5 or 6, carbon atoms. Normally, the N-alkyl polycarbonamide copolymer should contain no more than about 15 mole percent of amide groups from a nonsubstituted, diprimary diamine. Higher concentrations of such diamines tend to reduce to an unsatisfactory degree the antistatic effectiveness of the polymer. Suitable N-substituted diamines are the N-mono- and N,N'-disubstituted diamines containing from about 2 to 18 and preferably, 2 to 12 carbon atoms in the alkylene group. Suitable aliphatic dicarboxylic acids are those containing from about 1 to 18, preferably, 4 to 12 carbon atoms in the alkylene group.

Some suitable N-alkylated diamines for use in the preparation of the N-alkyl polycarbonamides are N,N'-diethyl-, -diisobutyl-, -di-n-butyl-, -dihexyl-, -diheptyl-, -didecyl- and -distearyl- ethylene, propylene, tetramethylene, hexamethylene, nonamethylene and decamethylene diamines as well as the mono-N-alkyl derivatives of these diamines.

Some suitable dicarboxylic acids for use in the preparation of the N-alkyl polycarbonamides are succinic, glutaric, adipic, pimelic, suberic, azelaic, sebacic, dodecanedioic and higher dicarboxylic acids and also such acids as N-N'-bis(ω-carboxyalkyl)piperazine.

Some suitable N-alkyl amino-carboxylic acids, or their amide-forming derivatives, which can be used to prepare suitable N-alkyl polycarbonamides for this invention are N-methyl-, -ethyl-, -isobutyl-, -n-butyl-, -hexyl-, -decyl-, etc., 11-aminostearic and ω-aminostearic acids.

Some suitable N-alkyl polycarbonamides are those prepared using N,N'-diethyl-hexamethylene, N,N'-diisobutylhexamethylene or N,N'-di-n-butyl-hexamethylene diamine and adipic, azelaic or dodecanedioic acid.

The N-alkyl polycarbonamides may contain other substituents, functional groups, copolymeric linkages or end-groups than those mentioned herein provided such modifications do not interfere with the required properties thereof as specified.

The N-alkyl polycarbonamides should have a molecular weight as determined by vapor pressure osmometry of greater than about 1500 corresponding to an inherent viscosity in meta-cresol of greater than about 0.1.

The molecular weight is regulated to the desired degree by polymerization conditions and by the use of viscosity stabilizers. Particularly suitable stabilizers are monofunctional carboxylic acids containing from 2 to 26 carbon atoms and monofunctional primary and secondary amines containing alkyl groups with from 1 to 18 carbon atoms. Suitable stabilizers are acetic, propionic, butyric, valeric, pivalic, enanthic, pelargonic, decanoic, myristic, palmitic, benzoic, cyclohexanecarboxylic acids and so forth.

Suitable polyether-esters are disclosed in Br. Pat. No. 1,176,648 and U.S. Pat. No. 3,655,821 and additional polyether-ester compositions are disclosed in the examples of this invention. Preferably the polyether-ester will be prepared from a polyether glycol having a molecular weight from about 200 to about 2000 and at least one dibasic acid that is a saturated aliphatic dibasic acid having at least 9, preferably 9 to 12, carbon atoms or an aromatic diacid such as terephthalic or isophthalic acid or ester-forming derivative.

The polyesters which may be employed are prepared from aliphatic glycols having 2 to 12 carbon atoms and aliphatic dibasic acids, or their ester-forming derivatives, having 4 to 36 carbon atoms or from hydroxycarboxylic acids of from 5 to 12 carbon atoms or equivalent such as caprolactone. dibasic acids, or their ester-forming derivatives, may be used in conjunction with the aliphatic dibasic acids. It should be noted, however, that excessive aromatic character in the polymer will be reflected in an increase in log $R_s$. As suitable reactants for preparing these polyesters there may be mentioned ethylene glycol, 1,3-propanediol, 1,4-butanediol, 1,6-hexanediol, 2,2-dimethyl-1,3-propanediol, 2-methyl-2-ethyl-1,3-propanediol, 2,2-diethyl-1,3-propanediol, 2,2,4-trimethylhexanediol, 2,4,4-trimethylhexanediol, glutaric acid, succinic acid, adipic acid, dodecanedioic acid, azelaic acid, terephthalic acid, dimer acid and their ester-forming derivatives.

The polymeric antistats can be made more conductive by the addition of a phosphonium salt. The phosphonium salt may be present as a separate material in the polymeric anti-stat or, by the choice of appropriate substituents on the anion of the salt, it may be reacted with a component of the polymeric antistat to become a part of the polymer molecule. When present as a separate material, the phosphonium salt must be dissolved in the polymeric antistat if the desired results are to be obtained. Preferably the alkyl groups attached to the phosphorous atom will have a total of at least 16 carbon atoms to increase their hydrophobicity and thus reduce their tendency to be extracted when in contact with an aqueous medium. For this reason salts such as those containing tetrabutylphosphonium and butyltrioctylphosphonium cations are preferred.

For a significant improvement in conductivity the phosphonium salt reactant should be copolymerized in the polymeric antistat to give a concentration of phosphonium sulfonium groups of 0.01 to 50 mole percent based on the moles of dicarboxylic acid units and/or aminocarboxylic acid units and/or hydroxycarboxylic acid units (i.e., residue of dicarboxylic reactants or functional equivalents) in the polymer chain. In the case of phosphonium salt additives, the amount used should be 0.2 to 35 weight percent based on total weight.

The phosphonium salt may be incorporated into the polymers by any convenient means such as by mixing either from solution or directly with the polymer in a fluid state, or it may conveniently be incorporated during the polymerization of the polymer.

For optimum antistatic effect, it is preferred that the phosphonium salt be present in a sufficient concentration to provide the core composition with a log $R_s$ of less than 8.

As suitable phosphonium salts (additives) for use in this invention there may be mentioned in addition to those of the examples below, methyltributylphosphonium tosylate, di(methyltricyclohexylphosphonium) naphthalenedisulfonate, benzyltriphenylphosphonium toluenesulfonate, trioctylbutylphosphonium xylenesulfonate, tetraoctylphosphonium phenylphosphinate, tetrabutylphosphonium dimethylphosphate, di(methyltribenzylphosphonium) phenylphosphonate, methyltritolylphosphonium benzoate, and ethyltriphenylphosphonium stearate. When the phosphonium salt is used in an N-alkylpolycarbonamide, the carbon atoms attached to the phosphorus atom of the phosphonium group must be aliphatic.

As suitable phosphonium salt reactants (or additives) there may be mentioned in addition to those of the examples below, methyltriphenylphosphonium, 3,5-dicarboethoxybenzenesulfonate, tetraphenylphosphonium 3,5-dicarbomethoxybenzenesulfonate, methyltrioctylphosphonium 3,5-dicarbomethoxybenzenesulfonate, and the corresponding 5-[4-(phosphonium sulfo)phenoxy]isophthalates and 5-[4-(phosphonium sulfo)propoxy]isophthalates.

Branching agents, i.e., polymer reactants having more than two functional groups may be added when it is desired to increase the viscosity of the antistatic polymers. As suitable branching agents there may be mentioned pyromellitic dianhydride, trimethylol propane, pentaerythritol and bis-(hexamethylene)triamine.

In the preparation of the above described antistatic filaments, the core polymer is metered as a continuous stream into the core region of a stream of the fiber-forming polymer immediately prior to spinning to provide a volume of 10 percent or less of the total filament stream. The extruded filaments having a continuous core consisting essentially of the conductive polymer are then quenched and collected. Spinning of the core is especially facilitated if the polymer has a viscosity of at least 10 preferably at least 100 centipoises at the filament spinning temperatures to be employed. Because of their low $T_g$ and noncrystalline nature, the core polymers are much more fluid at normal fiber spinning temperatures, for example 225° to 340° C., than the fiber-forming polymers. Because of the large disparity between the melt viscosities of the fiber-forming and the core polymers, care should be taken in spinning filaments of this invention to meter accurately such a low viscosity component at such a low relative volume uniformly to a plurality of filaments.

A spinneret-pack-assembly designed to produce sufficient pressure drop in the distribution and meter plate zones should be used. Capillary tubing inserts (in place of drilled holes) or thin narrow channels formed in very thin sandwiched meter plates can be used to distribute the core polymer uniformly to the spinneret capillaries. Capillary tubing inserts with 0.08 × 2 and 0.2 × 10 mm. inside diameters and lengths are useful. The meter plates may be as thin as from 0.025 to 0.25 mm. These techniques for metering the core polymer, coupled with the plateau spinneret technique as described in the Kilian patent, U.S. Pat. No. 2,936,482 can be used successfully to control the flow and location of the core polymer to produce filaments of the invention. Special care must also be taken to machine pack parts sufficiently precisely to prevent leakage of the low viscosity core polymer.

The low temperatures suitable for handling the low $T_g$ core polymer avoid the need for a screw-melter commonly used in bicomponent spinning. A heated hopper pressurized with an inert gas such as nitrogen can be connected to a meter pump for forwarding the polymer to the spinning machine.

The amount of antistatic activity provided by the antistatic filaments may be determined by a number of measurements.

TESTS AND MEASUREMENTS

The filaments may be converted to fabric, and the static propensity of the filaments determined by measuring the amount of direct current that passes through the filling of the fabric at a temperature of 22° C. and 26% relative humidity (see Magat et al. U.S. Pat. No. 3,475,898). The ohms per square unit of area of fabric surface is determined according to the AATCC Method, 76-59 ("Technical Manual of the AATCC", Volume 41, 1965, pages B-188). This value, given as log R, is the logarithm to the base 10 of the fabric resistance. Higher values indicate a greater tendency to acquire and retain an electrostatic charge. This method provides an approximate measure of static propensity. However, to compare filaments one should determine the log rho of the filaments, which takes into account differences in total yarn cross-section. Log rho is obtained from the expression: log rho (filament) = log $R$ (fabric) − log $(9 \times 10^5 D)$ + log $(Pd)$ where D is the density of the polymer, P is the number of picks (filling yarn ends) per centimeter in the fabric and d is the total denier of each pick. When the pick yarns contain filaments that have cores of a polymeric antistat (conductive filaments) in combination with filaments without the polymeric core antistat (nonconductive filaments), the (Pd) value is multiplied by the portion of conductive filaments in the pick to obtain the log rho reported for the conductive filaments. In the examples, the following values of D are used: 1.15 for 66 polyamide; 1.0 for 612 polyamide; 1.0 for the polyamide from bis(4-aminocyclohexyl) methane and 12-acid; 1.4 for polyethylene terephthalate; and 0.9 for polypropylene.

Filaments having a log rho value not greater than 11 are considered to have acceptable antistatic properties. It will be understood that filament denier, sheath and core proportions and composition affect the log rho. These parameters should be so selected to yield filaments with log rho $\leqq$ 11 and preferably less than 9.5.

For carpets, the static propensity of the antistatic filaments can be determined by using the filaments to make a carpet and measuring the electrostatic voltage built up on a person walking upon a section of the carpet at 21° C. and 20% relative humidity. The procedure for this measurement referred to as the Shuffle Test is described in AATCC Test Method 134-1964 with changes adopted by the Carpet & Rug Institute, September, 1971.

Static propensity of the filaments also can be determined by a measurement of decling time in a procedure referred to as the Sail Test. The Sail Test used herein measures the severity and duration of garment cling due to static under simulated use conditions. In this test, static is induced in a garment, which may be, for example, a slip, a skirt or a dress, worn over cotton briefs by a technician, by rubbing against a fabric held between two vertical poles. A polyethylene terephthalate fabric is used with a polyamide garment and a poly(hexamethylene adipamide) fabric is used with a polyester garment. The time taken for the garments to uncling (or decling) while being worn during walking around the room is determined. The room is maintained at 21° C. and 20% relative humidity. The decling time is the time in minutes required for the garment to be judged comfortable with no detectable cling from static charges. The results commonly are reported after a number of "C" washes. The garments containing the antistatic filaments have decling times less than 10 minutes and preferably less than 2 minutes.

Fabrics which are given a number of "home" wash-dry cycles in a tumble washing machine with a synthetic detergent in water at 38° C., spun-dried and tumble-dried at 77° C., are referred to as being "C" washed.

The specific resistance, $R_s$, of the polymeric anti-stat is determined in a conventional manner at room temperature on a dry composition. The composition is dried at 100° C. in an oven at a pressure less than 50 torr for at least 12 hours. The cell used for the measurements consists of a "Pyrex" glass tube of 2 ± 0.25 mm. inside diameter and 8 mm. outside diameter and is filled with antistat by sucking up from a molten pool of polymer. Copper electrodes are inserted through rubber end-caps at each end of the tube with 33 cm. electrode separation and the current transmitted through the sample at a potential difference of 220 volts DC is recorded using a Beckman Vibrating Reed Model 1051 microammeter. Specific resistance is calculated from the equation:

$$R_s \text{ (ohms)} = K_c/I \text{ (amps)}$$

The cell constant $K_c$ is determined by using a liquid of known specific resistance. The values reported herein used $7.63 \times 10^{-2}$ as the cell constant. For convenience, the $R_s$ value is reported as its $\log_{10}$ value. The lower the $R_s$ value, the higher is the conductivity of the sample.

The % core in the filament is the % of the cross-sectional area of the filament occupied by the core material. The core may be centrally located, off center and of any shape. The cross-sectional area is conveniently determined by photographing a cross-section of the filament under a microscope at 50 to 1500× and determining the % core from measurement of the photograph. In the case of irregularities, the average of 5 to 10 determinations is used.

For round filaments with round cores, the % core can also be determined by photographing the filament in a longitudinal view, immersed in a medium having a refractive index closely matching the refractive index of the filament, and measuring the filament and the core diameters and calculating the % core.

The Tg (NMR) is the temperature above which there is a rapid rise in the NMR peak ratio with an increase in temperature. The NMR peak ratio is determined from the NMR broadline spectrum measured at a given temperature on the dry polymer (e.g., dried at 125° C. for 15 minutes in dry nitrogen) in an atmosphere of dry nitrogen using a radio frequency of 56.4 megacycles at an attenuation setting of 17 decibels with a sweep modulation amplitude of one gauss. The NMR spectrum is measured using the nuclear magnetic resonance equipment of Varian Associates, Model V - 4302 Dual Purpose Spectrometer and their high temperature probe insert, Model No. V - 4331 TWL. The NMR spectrogram at a given temperature shows a broad absorption "hump" upon which is superimposed a vary narrow peak. The derivative curve of the spectrogram is recorded by the spectrometer; "peak ratio" measurements are made on this curve. The height of the narrow peak divided by the height of the "hump" gives the "peak ratio," as described in J. Polymer Science Part C, Polymer Symposia, No. 3, pp. 3–8 (1963).

The relative viscosity of the polyamides is determined by measuring the ratio of the flow time in a viscometer of a polymer solution relative to the flow time of the solvent by itself measured in the same units at 25° C. Unless otherwise specified the relative viscosity is determined using an 8.4%, by weight, based on total weight, solution in a 90%, by weight, based on total weight, aqueous formic acid solution.

Inherent viscosity, $\eta_{inh}$, is determined from the expression:

$$\eta_{inh} = \text{Log}_e \eta/C$$

where $\eta$ is the viscosity of a dilute solution of the polymer in m-cresol divided by the viscosity of m-cresol in the same units and at the same temperature and C is the concentration of the dilute solution in grams of polymer per 100 ml. of solution. In the examples, the temperature used is 25° C. and the value of C used is 0.5.

The relative viscosity of the polyesters is determined (unless indicated otherwise) by measuring the ratio of the viscosity of a solution containing 4.75% by weight of the polymer, in hexafluoroisopropanol containing 100 parts per million, by volume, of concentrated sulfuric acid, to the viscosity of the hexafluoroisopropanol sulfuric acid solvent measured in the same units at 25° ± 0.05° C.

In the procedures and examples that follow, all percentages are by weight, based on total weight, unless indicated otherwise and percent core is percent by volume.

PREPARATION OF PHOSPHONIUM SALTS

Tetra-n-butylphosphonium Phenylphosphinate (Salt A)

A solution of 147.5 grams of tetra-n-butylphosphonium chloride in 1 liter of ethyl alcohol is stirred in a 3-liter round-bottom flask fitted with a reflux condenser and a heating mantle. To it is added a solution of 90 grams of potassium phenylphosphinate in 500 ml. ethyl alcohol. A white precipitate separates immediately. The mixture is refluxed for 2 hours and is then cooled to room temperature, and is filtered. Solvent is removed from the filtrate with a rotary evaporator. The phosphonium salt remains behind as an oil.

Tetra-n-butylphosphonium Diphenylphosphinate (Salt B)

To a suspension of 43.6 grams of diphenylphosphinic acid in 300 milliliters of distilled water is added a solution of 8.0 grams of sodium hydroxide in 200 milliliters of water and the mixture stirred. The acid dissolves slowly. To the resulting solution is added a solution of 59 grams of tetra-n-butylphosphonium chloride in about 200 milliliters of distilled water. The reaction mixture is stirred for half an hour and is then extracted with about 500-milliliter portion of chloroform. The extract is dried over anhydrous $Na_2SO_4$ and the chloroform is then distilled. A light-brown viscous liquid remains. It is dried overnight at 80° C. On cooling, tetra-n-butylphosphonium diphenylphosphinate separates as white crystals.

Tetra-n-butylphosphonium 3,5-Dicarbomethoxybenzenesulfonate (Salt C)

A solution of 295 grams of tetra-n-butylphosphonium chloride and 296 grams of sodium 3,5-dicarbomethoxybenzenesulfonate in 1.5 liters of water is stirred 1 hour at 60° C. The phosphonium salt separates as a clear liquid at the bottom. It is separated and dried overnight at 100° C. at a pressure less than 50 torr. On cooling to room temperature it solidifies to a white solid which melts at 73° C.

Tri-n-Octyl-n-butylphosphonium 3,5-Dicarbomethoxybenzenesulfonate (Salt D)

Tri-n-octyl-n-butylphosphonium bromide is prepared by slowly dripping tri-(n-octyl)phosphine (740 grams) into refluxing 1-bromobutane (500 grams) in a nitrogen atmosphere. Reflux is continued one hour after final addition then the solution is cooled with stirring for about 18 hours, followed by vacuum removal of excess 1-bromobutane at 60° C. This product, 1210 grams from two successive preparations, is added to 880 grams of sodium 3,5-dicarbomethoxybenzenesulfonate in 2500 milliliters of water and stirred for at least 1 hour at 85° C. then the heat is removed and the oil in water mixture is allowed to stir and cool for about 18 hours. The oil layer is separated from the water, rinsed with 1000 milliliters of water and dried at about 80° C. at a pressure less than 2 torr for 18 hours. This product, an oil, is tri-n-octyl-n-butylphosphonium 3,5-dicarbomethoxybenzenesulfonate with 4.2% phosphorous and 4.7% sulfur by analysis.

Tetra-n-butylphosphonium Xylenesulfonate (Salt E)

A mixture of 370 grams sodium xylenesulfonate in 1000 ml water is stirred and heated until complete dissolution of the sulfonate, then 500 grams tetra-n-butylphosphonium chloride is added. After complete dissolution of the chloride, the reaction mixture is cooled and the phosphonium sulfonate separates as a light yellow viscous liquid. It is dried at 60° C. overnight.

PREPARATION OF POLYMERIC ANTISTATS

Polyamide Antistats

The procedure for the preparation of the N-alkyl polycarbonamide antistats is described below for the polyamides of Table I and the polymer properties are given in Table II. An autoclave is charged with the number of grams of the ingredients specified in Table I, purged with nitrogen and heated to 215° C. for three hours at a pressure not greater than 21.1 kilograms per square centimeter gauge. The autoclave is provided with an agitator which operates at a speed of 6 to 8 rpm. The pressure is reduced to atmospheric over a period of 60 minutes while the temperature is raised to 295° C. The pressure is then reduced to less than 10 torr over a 30-minute period and is held there for 3 hours at 300° ± 5° C. The pressure is brought to atmospheric with nitrogen, and the polymer extruded at 200° C.–295° C. under a blanket of nitrogen.

Polyamide A has a $T_g$(NMR) of −15° C. Polyamides D and G contain dissolved phosphonium salt. For example, in the case of polyamide G, the phosphonium salt, (Salt B), was in the charge to the autoclave. It is also possible to mix the phosphonium salt with molten polymer.

Polyamides E and F are copolyamides formed from Salt C and the reactants used to form the N-alkylpolyamide.

below for the polyesters whose properties are shown in Table III. A still is charged with 11,700 grams of dimethyl azelate, 2250 grams of 2,2-dimethyl-1,3-propanediol, 1360 grams of Salt C, 100 grams of 2-ethyl-2-hydroxymethyl-1,3-propanediol, 4 grams of sodium acetate trihydrate, 11.2 grams of manganese acetate tetrahydrate, 7.7 grams of antimony oxide, and 6200 grams of ethylene glycol. The temperature of the still is raised to 230° C. and about 2700 grams of methanol and about 1600 grams of ethylene glycol are removed by distillation. The batch is then transferred to an autoclave at 230° C. which has been purged with nitrogen and 8.3 ml. of 85%, by weight, phosphoric acid is added. The autoclave is equipped with an agitator which is operated at 30 rpm. The pressure is reduced to less than 2 torr for 4–5 hours. The pressure is then brought to 3.9 kilograms per square centimeter gage with helium and the polymer extruded under a blanket of nitrogen. Three separate batches, Polyesters A, B and C are prepared. A fourth batch, Polyester D, is prepared as above with the same amounts of ingredients except that the phosphonium salt is Salt D. Polyester F is prepared similarly except that Salt E is employed.

Polyester E is prepared by charging an autoclave with 2480 grams of di(2-hydroxyethyl)azelate, 680 grams of the di(2-hydroxyethyl) ester of dimer acid, 270 grams of Salt C, 700 grams of ethylene glycol, 5 grams of 2-ethyl-2-hydroxy-methyl-1,3-propanediol and 1 ml. of tetrabutyl titanate. Dimer acid is a 36-carbon, long-chain, aliphatic dibasic acid containing alkyl groups near the center of the molecule. The autoclave is purged with nitrogen and heated. The agitator is turned on at 8 rpm when the autoclave temperature is 150° C. Nitrogen is passed through the bottom of the clave to increase agitation of the contents. When the temperature reaches 180° C. the agitator speed is increased to about 24 rpm. The pressure is reduced to less than 50 torr. The batch is held at 240° C. for 2 hours and then at 260° C. for 4 hours at a pressure of less than 50 torr. At the end of this period the nitrogen and the agitator are turned off. The polymer is extruded at 260° C. under nitrogen.

TABLE I

| Polyamide | Salt[1] | Excess Diamine[2] | Formic Acid | Boric Acid | Potassium Phenylphosphinate | BHMT[3] | Phosphonium Salt |
|---|---|---|---|---|---|---|---|
| A | 3200 | 80 | 20 | 7 | 4.5 | — | — |
| B | 3200 | 93 | 20 | 7 | 4.5 | — | — |
| C | 4000 | 74 | 21 | 7.5 | 10 | — | — |
| D | 3200 | 78 | 20 | 7 | 4.5 | — | 300 (Salt A) |
| E | 3200 | 180 | 20 | 7 | 4.5 | 23 | 65.7 (Salt C) |
| F | 3200 | 140 | 20 | 7 | 4.5 | 18.5 | 65.7 (Salt C) |
| G | 3200 | 78 | 20 | 7 | 4.5 | 30 | 320 (Slt B) |

[1]The salt for Polyamide C is N,N'-diethylhexamethylene diammonium azelate, all other salts are N,N'-diethylhexamethylene diammonium dodecanedioate.
[2]Diamine is N,N'-diethylhexamethylene diamine.
[3]Bis-(hexamethylene)triamine.

TABLE II

| Polyamide | Log $R_s$ | Relative Viscosity | Inherent Viscosity | Amine End Groups[1] | Carboxyl End Groups | Molecular Weight | Amorphous Character |
|---|---|---|---|---|---|---|---|
| A | 8.8 | — | — | 36 | 52 | 26,400 | Rubbery |
| B | — | — | — | 44 | 45 | 28,800 | Rubbery |
| C | 8.8 | — | 1.19 | 37 | 22 | — | Gummy |
| D | 7.0 | — | 0.72 | 28 | 132 | 13,700 | Gummy |
| E | 7.5 | 69 | — | 80 | 2 | 48,600 | Rubbery |
| F | 7.5 | 40 | — | 51 | 44 | — | Rubbery |
| G | 6.7 | 12 | — | 166 | 147 | — | Syrupy |

[1]Microgramequivalents per gram of polymer

Phosphonium Salt-modified Polyester Antistats

The procedure for the preparation of the phosphonium salt-modified polyester antistats is described

TABLE III

| Polyester | Inherent Viscosity | Log $R_s$ | Amorphous Character |
|---|---|---|---|
| A | 1.4 | 6.4 | Gummy [$T_g$ (NMR) of −22° C.] |
| B | 1.1 | 6.4 | Gummy |
| C | 1.2 | 6.4 | Gummy |
| D | 1.4 | 6.3 | Gummy |
| E | 1.03 | 6.7 | Gummy |
| F | 0.87 | 5.8 | Gummy |

Polyether-ester Antistats

The procedure for the preparation of the polyether-ester antistats is described below for the polyether-esters whose properties are shown in Table V.

Polyether-ester A is prepared by charging an autoclave with 5550 grams of dodecanedioic acid, 4640 grams of polyethylene glycol of 200 average molecular weight, 1160 grams of Salt C, 375 grams of 2-ethyl-2-hydroxymethyl-1,3-propanediol (branching agent), 11 grams of p-toluenesulfonic acid, and 11 grams of manganese acetate. The autoclave is purged with nitrogen. The reactants are then heated at 200° C. and the agitator is started at 15 rpm. The batch is held at 200° C. for 3 hours under a gentle bleed of nitrogen. The pressure is then reduced to less than 5 torr and the temperature is raised to 240° C. over a period of about 60 minutes. It is held at 240° C. for 6 hours at a pressure less than 5 torr. The batch is then brought to atmospheric pressure with nitrogen and extruded at 120° C. under a blanket of nitrogen. The yield is about 11.8 kilograms.

Polyether-esters B and C are prepared in a vacuum autoclave which has a still attached to it for the initial transesterification reactions.

Polyether-ester B is prepared by charging the still with 3500 grams of polyethylene glycol having an average molecular weight of 400, 4500 grams of polyethylene glycol having an average molecular weight of 600, 250 grams of Salt C, 3880 grams of dimethylterephthalate, 2480 grams of ethylene glycol, and 14.0 grams of tetrabutyl titanate. The temperature of the still is raised to 210° C. and about 1300 grams of methanol is removed by distillation. The batch is then transferred to an autoclave at 220° C. which has been purged with nitrogen. An agitator is operated at 15–30 rpm. The pressure is reduced to less than 2 torr in 45 minutes as the temperature is raised to 260° C. during this period. The batch is held at a pressure of less than 2 torr for 4 to 6 hours. The pressure is then brought to atmospheric with nitrogen and the batch is cooled to 220° C. and extruded under a blanket of nitrogen.

Polyether-ester C is similar to Polyether-ester B but without the phosphonium salt, and is prepared by the procedure used for Polyether-ester A using the following ingredients: 2950 grams of polyethylene glycol having an average molecular weight of 400, 4450 grams of polyethylene glycol having an average molecular weight of 600, 4000 grams of dimethylterephthalate, 2480 grams of ethylene glycol, 300 grams of 1,3,5-trimethyl-2,4,6-tri-(3,5-di-tertiarybutyl-4-hydroxybenzyl)benzene, and 14.0 grams of tetrabutyl titanate.

Polyether-esters D, E, F and G are prepared using the number of grams of the ingredients specified in Table IV, along with 1 ml. of tetrabutyl titanate which are charged to a stainless steel, agitated autoclave. The autoclave is heated to 180° C. under nitrogen then evacuated to less than 10 torr and heated to 240° C. The agitator is set at 8 rpm. while 51 cc./sec. nitrogen is bubbled through the mixture for added agitation. After 2 hours at 240° C., the temperature is raised to 260° C. for a 4-hour period and the nitrogen bubble flow reduced to 8 cc./sec. The batch is then extruded under nitrogen pressure after cooling to 220° C.

Polyether-ester H is made by the following procedure: Two hundred grams of polyethylene glycol having an average molecular weight of 200, 214 grams of dodecanedioic acid, 6.6 grams of pyromellitic dianhydride, 0.2 gram p-toluene sulfonic acid and 1 gram 1,3,5-trimethyl-2,4,6-tris(3,5-di-tertiary butyl-4-hydroxybenzyl)benzene are placed in a 500 ml. flask fitted with a steam-jacketed reflux condenser and a take-off condenser. After purging with nitrogen the materials are heated to approximately 130° C. and then raised to 225° C. at about 40° C. per hour. Vacuum is then applied at 0.2–0.5 torr and the temperature increased to 265° C. and held for about 2 hours until the polymer viscosity is 100 poise as measured in the flask with a rotating spindle viscometer.

Polyether-ester J is prepared by essentially the same procedure as Polyether-ester H except for the starting ingredients. Polyether-ester J ingredients are 200 grams of polyethylene oxide glycol having a molecular weight of 200, 206 grams dodecanedioic acid, 19.3 grams of phosphonium Salt C, 6.6 grams pyromellitic dianhydride and 0.2 gram p-toluene sulfonic acid.

TABLE IV

| Polyether-ester | DHET[1] | Polyethylene Glycol, Mol. Wt. 400 | 600 | 1000 | EHP[2] | 2G[4] | Phosphonium Salt | Antioxidant[3] |
|---|---|---|---|---|---|---|---|---|
| D | 2540 | 1850 | 2780 | — | 100 | — | — | 11 |
| E | 847 | — | — | 3333 | 100 | — | — | 50 |
| F | 2480 | 3700 | — | — | 100 | — | 110 (Salt C) | — |
| G | 1580 | 3700 | — | — | 100 | 600 | 2015 (Salt C) | — |

[1]Di (2-hydroxyethyl) terephthalate
[2]2-Ethyl-2-hydroxymethyl-1,3-propanediol
[3]1,3,5-Trimethyl-2,4,6-tri-(3,5-di-tertiaryburyl-4-hydroxybenzyl) benzene
[4]Ethylene glycol

TABLE V

| Polyether-ester | Inherent Viscosity | Log $R_s$ | Amorphous Character |
|---|---|---|---|
| A | 1.0 | 5.7 | Gummy |
| B | 1.2 | 6.8 | Gummy |
| C | 1.04 | 9.6 | Rubbery |
| D | 0.86 | 8.6 | Gummy [$T_g$(NMR) of 31 26° C.] |
| E | 0.93 | 8.8 | Rubbery (Semi-crystalline) [$T_g$(NMR) of −45° C.] |
| F | 1.07 | 7.9 | Gummy |
| G | 0.70 | 5.6 | Rubbery |
| H | — | 8.1 | Gummy [$T_g$(NMR) of −25° C.] |
| J | — | 6.1 | Gummy |

EXAMPLE 1

This example illustrates antistatic filaments having a polyamide sheath and an N-alkyl polyamide core.

a. A yarn of concentric sheath-core filaments is melt spun using poly(hexamethylene adipamide) for the sheath and 10% Polyamide A for the core and drawn to yield a 13-filament yarn having a denier of 40. Two such yarns are plied and woven into a fabric. The fabric log R is measured after the fabric is boiled-off for 60 minutes in distilled water and the filament log rho calculated to be 9.5. Another portion of the yarn is used in making tricot half-slips which are found to have a decling time of 0.3 minute in the sail test. Slips of unmodified poly(hexamethylene adipamide) had a decling time of 10 minutes.

b. A carpet yarn of concentric sheath-core filaments is prepared using poly(hexamethylene adipamide) for the sheath and 9% Polyamide C for the core. The yarn contains 26 filaments and is drawn to a denier of about 500. The filaments have a log rho of 9.9. In the shuffle test, the charge build-up is found to be 7 kilovolts compared to 20 kilovolts for an unmodified poly(hexamethylene adipamide) yarn.

c. A series of 60-denier, 34-filament trilobal sheath-core yarns is prepared using the polyamide from the salt of bis(4-aminocyclohexyl)methane (containing about 70% of the trans-trans stereoisomer) and dodecanedioic acid for the sheath and various amounts of Polyamides B and D as the core. The yarns are woven as the filling in fabrics. The log R values of the fabrics are then determined after the fabrics are scoured, bleached and "C" washed. The % core and filament log rho values are shown in Table VI.

TABLE VI

| % Core | Log Rho |
|---|---|
| Polyamide B | |
| 5 | 9.7 |
| 10 | 9.5 |
| Polyamide D | |
| 2.5 | 9.4 |
| 10 | 9.2 |

d. Polyamide E is spun as 2.3% core in poly(hexamethylene adipamide) filaments. The 10-filament yarn is drawn to a denier of 30 and 2-plied. The 2-plied yarn is woven as the filling in a fabric. After boiling the fabric in water for 3 hours and drying, the filaments have a log rho of 9.9.

e. Hosiery yarn having a sheath of poly(hexamethylene dodecanediamide) with a 9% core of Polyamide F can reduce apparel clinging due to static.

EXAMPLE 2

This example illustrates antistatic filaments having a polyamide sheath and a polyether-ester core.

a. Polyether-ester B is spun as a 2% core in poly(hexamethylene adipamide) which contains 2% $TiO_2$ to give a 10-filament yarn. The yarn is drawn 3.2X to a denier of 30, is two-plied and woven to a fabric. After being washed 30 times in a home laundry, the filament log rho is found to be 9.9. Tricot half-slips of this yarn have a decling time of 0.8 minute in the sail test. Control half-slips have a decling time greater than 10 minutes.

b. A yarn of concentric sheath-core filaments is prepared using poly(hexamethylene adipamide) for the sheath and 1.9% Polyether-ester H for the core. The yarn contains 10 filaments and is drawn to a denier of 30. Two of the yarns are plied and the plied yarns are woven into a fabric which is given a water boil-off. The filaments have a log rho of 10.0.

c. A yarn of concentric sheath-core filaments is prepared having a sheath of poly(hexamethylene adipamide) and a core of Polyether-ester J (5% core). The yarn is prepared and converted to fabric as described above. The log rho of the filaments is 8.9.

EXAMPLE 3

This example illustrates antistatic filaments having a polyamide sheath and a phosphonium salt-modified polyester core.

a. Polyester E is spun as 8% core in five filaments of a 10-filament, trilobal yarn. The polymer of the sheath is prepared from the salt of bis(4-aminocyclohexyl)methane (containing about 70% of the trans-trans stereoisomer) and dodecanedioic acid. The yarn is drawn to a denier of 30. The yarn is 2-plied and woven as the filling in a fabric and the log rho determined. The yarn is also used to knit a tricot fabric for preparing half-slips for sail testing. The fabric log rho and sail test results are given in Table VII.

TABLE VII

| antistatic Yarn | Log Rho After 30 "C" Washes | Fabric Decling Time, Min., After 30 "C" Washes |
|---|---|---|
| Sheath-Core Filaments | 9.7 | 1.4 |
| Control | >13.1 | 10 |

b. Polyester A is spun as 4% core in five filaments of a 10-filament trilobal yarn as above. The polymer of the sheath is the same as that above. Half-slips made from tricot fabric of this yarn after 30 "C" washes given an average decling time of 3.9 minutes in the sail test. Without the antistat in the yarns, the decling time is greater than 10 minutes.

c. Polyester D is spun as a 2% core in a round-filament yarn having a denier of 102 and 34 filaments. Three runs are made using poly(caprolactam), poly(hexamethylene adipamide) and poly(hexamethylene dodecanedioamide) as the sheath polymers. These yarns are woven as the filling in a fabric and all are found to have a log rho of 8.5 after a 1-hour scour at 100° C. in a solution containing 0.25 gram $Na_3PO_4 \cdot 12H_2O$ per liter.

d. Polyester D is also spun as the core of filaments in a 60-denier, 20-filament yarn. The antistat core in the yarn is 2.5%. The sheath polymer is the same as that used with Polyester E and seven filaments are spun with a core while the other filaments were unmodified. The yarn is woven as the filling in a fabric and the sheath-/core filaments found to have a log rho of 9.1 after 30 "C" washes.

All of the above fabrics are painted in the area of electrode contact with an electrically conductive paint prior to the conductivity measurement.

e. Polyester F is spun as a 4% core in a round filament yarn with a denier of 150 (34 filaments). The sheath polymer is that used in section a. of this example.

EXAMPLE 4

This example illustrates antistatic filaments having a polyester sheath and a polyether-ester core.

a. Polyether-esters B, C and E are separately spun as 2% core in poly(ethylene terephthalate) yarn filaments. The polyethylene terephthalate polymer has a relative viscosity of 30 and contains 0.3% $TiO_2$. The relative viscosity is determined using a 10% by weight, based on total weight, solution of polymer in a mixture of 10 parts, by weight, of phenol and 7 parts of 2,4,6-trichlorophenol. The spun yarns have 34 filaments and are drawn to a denier of 150. A portion of each drawn yarn is woven as a filling in a fabric for log rho determination. Another portion is textured and used to provide double-knit fabrics which are dyed. The double-knit, dyed fabrics weighed 0.7 gram per square centimeter and are used for making skirts that are tested in the sail test. Log rho values and decling times are shown in Table VIII.

TABLE VIII

| Core | Log Rho After 10 "C" Washes | Declining Time, Min. After 30 "C" WAshes |
|---|---|---|
| Polyether-ester B | 9.7 | 0.5 |
| Polyether-ester C | 11.0 | 1.7 |
| Polyether-ester E | 10.2 | 1.6 |
| None | >13.1 | >10 |

b. Polyether-ester D is spun as 2% core in polyethylene terephthalate yarn filaments. The poly(ethylene terephthalate) polymer has a relative viscosity of about 22 and contains 0.3% $TiO_2$. The spun yarn has 34 filaments and is drawn to a denier of 150, and Polyether-ester D is present in substantially all of the filaments.

Fabrics and skirts are prepared as described above in part a. of this example with both the fabrics and skirts being given 30 "C" washes before testing. The fabric is painted with electrically conductive paint in the area of electrode contact, to assure complete electrical contact with each filament, and is found to have a log rho of 10.4. The skirts are found to have a decling time of 0.7 minute.

c. Polyether-ester G is spun as 0.5% core in one filament of a 34 continuous filament yarn of poly(ethylene terephthalate) which contains 0.2% $TiO_2$. The yarn is drawn to a denier of 150. After being woven as the filling in a fabric and after 10 "C" washes, the filament has a log rho of 9.6 whereas without the core the log rho is >13.1. Electrically conductive paint is used as above.

EXAMPLE 5

This example illustrates antistatic filaments having a polyester sheath and a polyester core.

Polyester B is spun as 4% core in polyethylene terephthalate yarn filaments. The yarn contains 34 filaments and is drawn to a denier of 150. The yarn is woven as the filling of a fabric which is given 30 "C" washes. Silver paint is applied to the washed fabric in the area of electrode contact to assure complete electrical contact with every filament. The log rho is then measured and found to be 8.6.

EXAMPLE 6

This example illustrates antistatic filaments having a polyolefin sheath and a polyester core.

Polyester C is spun as a 2% core with a polypropylene sheath. The yarn has a drawn denier of 102 and 34 filaments. The yarn is woven as a filling in a fabric and boiled 60 minutes in a solution containing 50 grams per liter of $Na_3PO_4 \cdot 12H_2O$, rinsed and dried. The filaments are found to have a log rho of 8.9.

What is claimed is:

1. An antistatic filament comprising a sheath of a fiber-forming synthetic polymer selected from the class of polyamides, polyesters and polyolefins and a core consisting essentially of an amorphous fluid-like organic polymer having a log $R_s$ of less than 10 and a glass transition temperature as measured by nuclear magnetic resonance, Tg (NMR) of less than 25° C., and selected from the group consisting of N-alkyl polyamides; polyether-esters; and ionically modified N-alkyl polyamides; ionically modified polyether-esters; and ionically modified aliphatic polyesters, with said ionically modified polymers having the ionic modifier copolymerized therewith, the said core constituting less than about 10% of the cross-sectional area of the filament.

2. The antistatic filament of claim 1 wherein the core is an N-alkyl polyamide or a polyether-ester.

3. An antistatic filament according to claim 1 wherein the core constitutes from about 2–6% of the cross-sectional area of the filament.

4. The antistatic filament of claim 2 wherein the core contains an ionic modifier dissolved in the polymer.

5. The antistatic filament of claim 1 wherein the fiber-forming synthetic polymer of the sheath is a polyamide and the core is an N-alkyl polyamide.

6. The antistatic filament of claim 1 wherein the fiber-forming synthetic polymer of the sheath is a polyamide and the core is a polyether-ester.

7. The antistatic filament of claim 1 wherein the fiber-forming synthetic polymer of the sheath is a polyester and the core is a polyether-ester.

8. An antistatic filament according to claim 1 having a log rho of less than 9.5.

9. An antistatic filament according to claim 1 wherein the core is ionically modified by having a phosphonium salt copolymerized therewith.

10. The antistatic filament of claim 1 wherein the fiber-forming sheath is a polyolefin.

11. The antistatic filament of claim 1 wherein the sheath is a polyamide.

12. The antistatic filament of claim 1 wherein the sheath is a polyester.

13. An antistatic filament comprising a sheath of a fiber-forming synthetic polymer selected from the class of polyamides, polyesters and polyolefins and a core consisting essentially of an amorphous fluid-like aliphatic polyester containing an ionic modifier dissolved therein and having a log $R_s$ of less than 10 and a glass transition temperature as measured by nuclear magnetic resonance, Tg (NMR) of less than 25° C., the said core constituting less than about 10% of the cross-sectional area of the filament.

14. The antistatic filament of claim 13 wherein the ionic modifier is a phosphonium salt.

* * * * *